United States Patent [19]

Livermore

[11] 4,083,123

[45] Apr. 11, 1978

[54] JIGSAW PUZZLE WITH EXTRA INTERLOCK

[76] Inventor: Cynthia S. Livermore, 398 Walsh Rd., Atherton, Calif. 94025

[21] Appl. No.: 779,317

[22] Filed: Mar. 21, 1977

[51] Int. Cl.[2] ..... A63F 9/10

[52] U.S. Cl. ..... 35/73; 35/8 R; 273/157 R

[58] Field of Search ..... 35/56, 73; 273/157 R, 273/157 A

[56] References Cited

U.S. PATENT DOCUMENTS 2,972,820 2/1961 Cano ..... 35/56

OTHER PUBLICATIONS

Children's House, vol. 4, No. 4, Sept. 1970, pp. 16–19, "Generating the Child," by David Davis.

Creative Playthings Catalog rec'd., Sept. 1970, p. 18, "Junior Lock Box."

Sears-Roebuck Catalog, Fall-Winter 1963, p. 1227, "Ponderosa Pine Storm-Screen Doors."

*Primary Examiner*—Harland S. Skogquist

*Attorney, Agent, or Firm*—Herbert C. Schulze

[57] ABSTRACT

This invention is a teaching aid for use by children and others in learning the association between mechanical items. It is characterized by two parts of a mechanical item which are capable of being connected together, being respectively connected to different portions of pieces of a jigsaw puzzle-type apparatus in such manner that when the jigsaw puzzle is correctly assembled, the matching mechanical elements will be in a position to be joined together, and in such manner that when all such items are correctly joined together the jigsaw puzzle will remain in an assembled configuration until the elements are disconnected.

4 Claims, 4 Drawing Figures

JIGSAW PUZZLE WITH EXTRA INTERLOCK

BACKGROUND OF THE INVENTION

1. Field of the Invention

This invention is in the general field of teaching aids, and is more particularly directed to a teaching aid wherein children and the like may be instructed in the use of such items as door fasteners, window fasteners, and the like, which units consist of more than one part, and wherein the proper parts must be matched for proper useage. It is even more particularly directed to such a teaching aid wherein, by reason of the configuration of the base elements to which different mechanical parts are attached in such manner that both the base elements and the mechanical elements must be properly interconnected.

2. Description of the Prior Art

There are many teaching aids for various purposes, including the purpose of attempting to teach children the association between mechanical elements such as door fasteners and the like.

In each case of such a teaching aid, the two or more portions of the mechanical element will be connected to two different elements which cannot be separated from their natural configuration into proper usage. For example, there are miniature doors fastened within miniature frames in such manner that door catches may be connected when the doors are closed and the like.

The present invention utilizes door catches and the like consisting of two different parts by having the individual parts so connected that they will mate and cooperate in the proper manner, but in which the different elements are connected to different elements of a jigsaw-type puzzle. In this manner, the different elements comprising one complete fastener or the like may become completely disassociated, and the pupil will be faced with the necessity of determining which of the elements match with other elements from other hardware-type items or the like. The elements are so connected that that they are attached to parts of a jigsaw puzzle, so that if the pupil makes a mistake in matching two different elements, he will be shown he is wrong by the impossibility of bringing the elements together since the jigsaw puzzle parts will not match in such manner that they can be brought together. There is no prior art of a teaching device combining the jigsaw puzzle with the disassociated parts of matching hardware items and the like.

SUMMARY OF THE INVENTION

There are numerous teaching aids of various types for pupils of almost every category, and for special persons such as handicapped persons and the like. Teaching aids are designed for numerous special purposes and teachers are accustomed to the use of teaching aids for various purposes including such purposes as teaching the proper usage and connection between common hardware items such as door catches, hasps, luggage fasteners, and the like.

The use different types of door fasteners and the like can be taught merely by instruction, illustrations and demonstrations with the individual items.

Aids have been developed for the use of such matching elements in their natural environment. For example, a miniature door may be utilized to show the relationship between two different parts of a hinge and the method of putting a pin between these parts; the door may also be used for showing the relationship between the part of the door latch connected to the frame and that part connected to the door; the same may be said for window fasteners, hasps, screw eyes and hooks, and numerous other commonly used devices.

The problem arises of sufficient studying of the parts to enable a pupil who is unfamiliar with the items to correctly and quickly distinguish which elements go together and what their function may be.

If the various elements of two-part units are mixed together, it is sometimes a frustating and lengthy problem for the pupil to sort them out and to properly establish their relationships.

I have studied this situation and have now devised and developed an interesting new way in which properly to illustrate the matching characteristics of two-part elements, together with an arrangement of such elements that they may be totally disassociated and intermixed with other elements, yet, in which the student can make absolutely no mistake in joining the appropriate pairs together. I have accomplished this by making a jigsaw puzzle-type arrangement of different elements of wood or the like, and fastening matching units to different pieces of the jigsaw puzzle across a cut portion in such manner that the properly matched unit can only be associated when the puzzle parts fit together; thus, there will be no misunderstanding the association of the different parts. When all of the matching elements are properly connected, the jigsaw puzzle will be in its correct configuration and will be totally joined together.

It is an object of this invention to provide a teaching device suitable to instruct students in the proper mating characteristics of different hardware-type items.

Another object of this invention is to provide a teaching device as mentioned wherein numerous dissimilar matching items may be supplied to the student in such manner that the student cannot properly join mismatches.

Another object of this invention is to provide such a teaching aid as mentioned wherein the means by which different elements are brought into contact with one another is by being connected to different parts of a jigsaw puzzle.

The foregoing and other objects and advantages will become apparent to those skilled in the art upon reading the description of a preferred embodiment which follows in conjunction with a review of the appended drawings.

DESCRIPTION OF A PREFERRED EMBODIMENT

Figure 1:
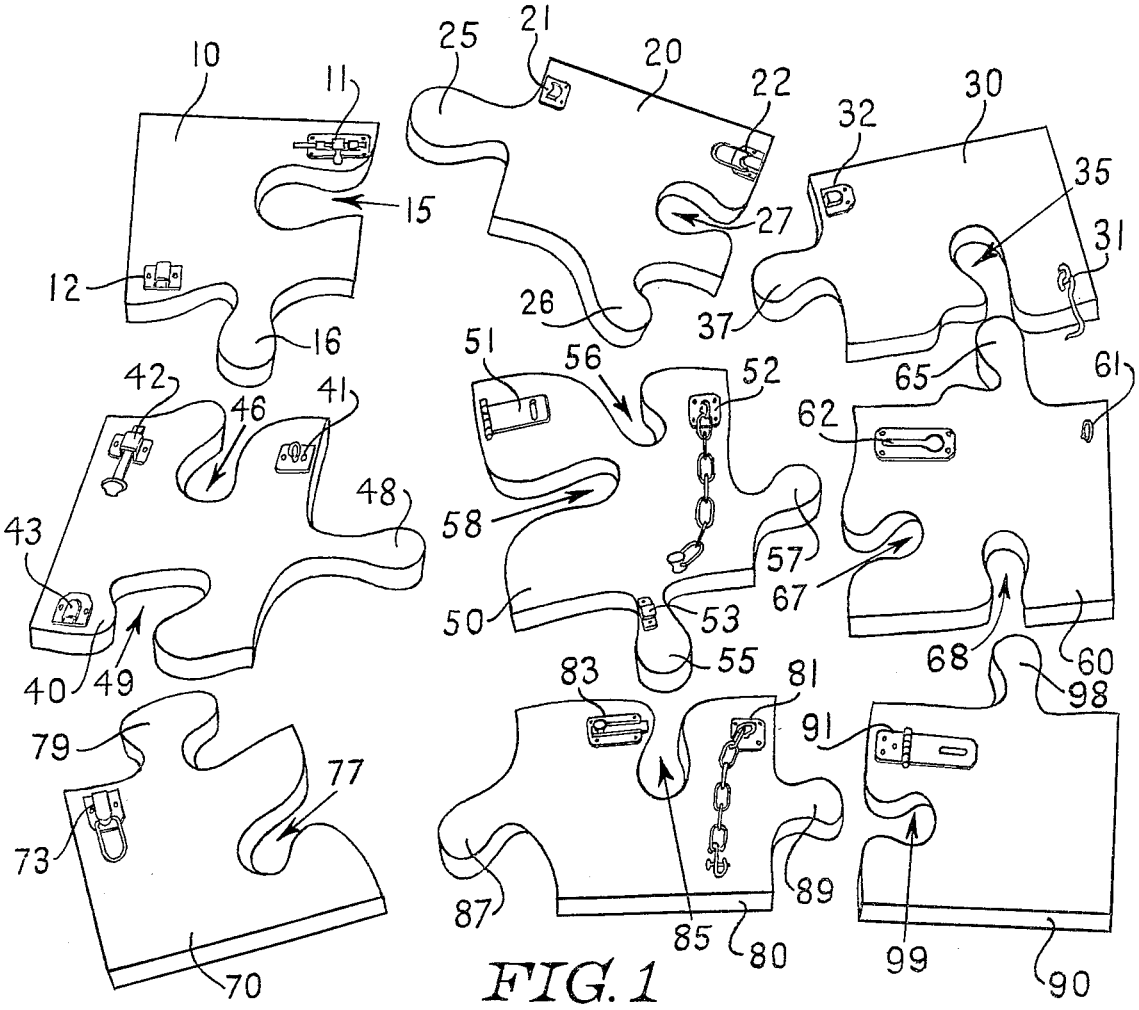
FIG. 1 is a perspective of a preferred embodiment of this invention with the various pieces disconnected from one another.

Attention should be directed first to FIG. 1. In FIG. 1, there are shown nine different and distinct pieces of a jigsaw-type puzzle, such nine pieces being respectively indicated by the numerals 10, 20, 30, 40, 50, 60, 70, 80, and 90. It will be noted that element 10 has a cutout opening 15 and a protrusion 16. It also carries a portion of a hardware-type item 11 and another portion of a different type hardware item 12. The cutout portion 15 of element 10 is of the appropriate size and shape to accommodate and interlock with protrusion 25 on element 20. Element 20, likewise, has a protrusion 26 suitable to engage opening 56 in element 50. Element 20 also has an opening 27 suitable to accommodate protrusion 37 on element 30. It will be noted that two hardware items 21 and 22 appropriately designed to match and connect with elements 11 and 32 respectively have been provided.

The jigsaw-type puzzle element 30 carries hardware element 32 and hardware element 31. The opening 35 will be suitable to engage with the protrusion 65 on element 60 and hardware device 61 will be an appropriate matching portion to engage with 31.

Puzzle element 40 carries hardware elements 42, 43, and 41, which will engage respectively with 12, 73, and 51.

The opening 46 will accommodate protrusion 16, the opening 49 will accommodate protrusion 79, and the protrusion 48 will ultimately engage in the opening 58.

Element 50 carries the hardware item 51 matching with hardware item 41, as previously mentioned, and two other hardware items 52 and 53 matching respectively with 62 and 83. The opening 56 will accommodate 26 and the protrusions 57 and 55 will engage within the openings 67 and 85 respectively.

Element 60 has now had most of its portions appropriately defined, and it will be noted that the hardware element 62 matches with the hardware element 52 from puzzle element 50. The opening 68 on puzzle element 60 will appropriately accommodate opening 98 on element 90.

The element 70 has an opening 77, which will appropriately engage protrusion 87 on puzzle element 80. The hardware item 73 interlocks with element 43.

The element 83 on puzzle portion 80 will engage matching element 53, when the protrusion 55 is appropriately positioned within opening 85. Likewise, the unit 81 and the unit 91 will properly engage when the protrusion 89 is engaged within the opening 99. The protrusion 98 will become engaged within the opening 68.

Figure 2:
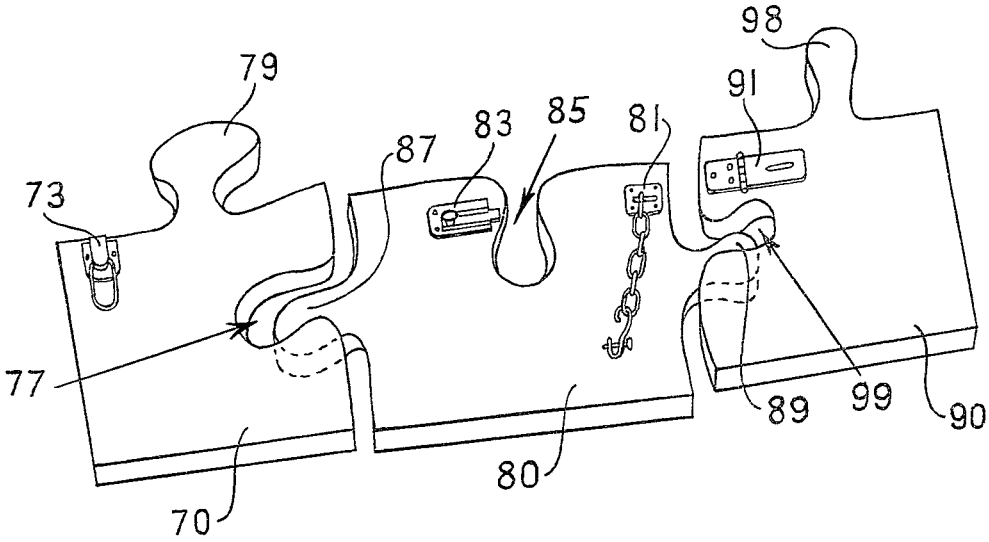
FIG. 2 is a perspective of three of the elements of FIG. 1 showing the manner in which they may be joined together.

With attention directed to FIG. 2, it is made more clear how the protrusion 87 interlocks with the opening 77, and how the protrusion 89 interlocks with the opening 99.

Figure 3:
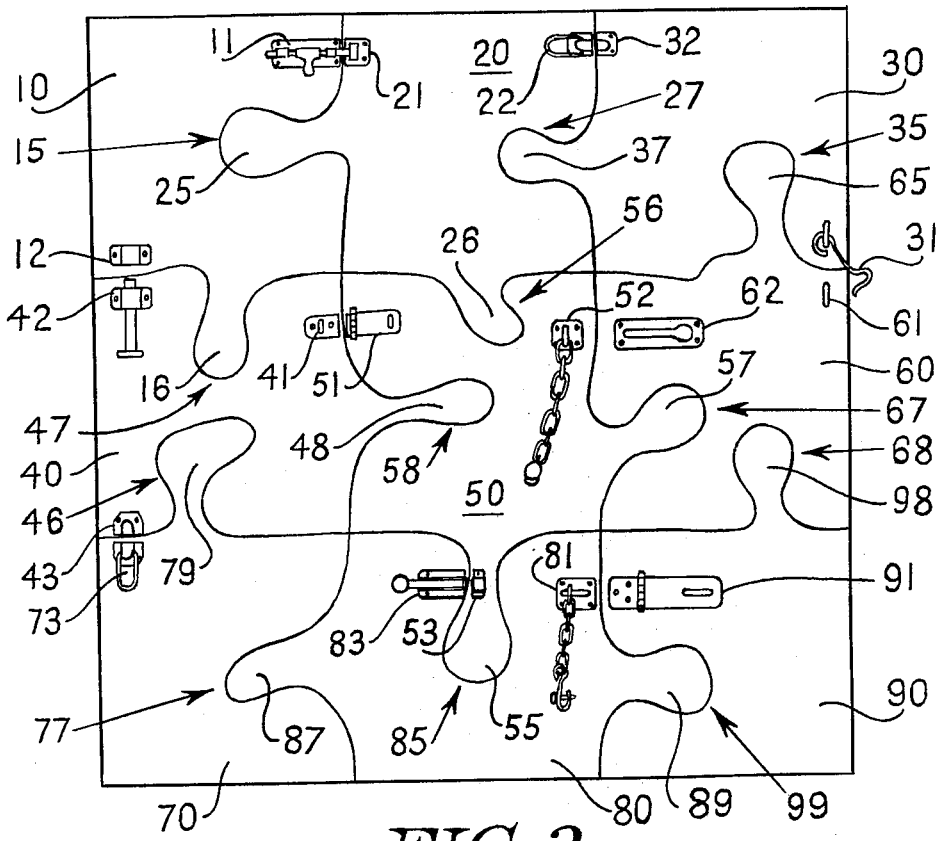
FIG. 3 illustrates the embodiment of FIG. 1 with all of the base elements completely joined together and the hardware elements disconnected.

In FIG. 3, all of the various puzzle openings, protrusions and configurations have been appropriately joined as will be clear. For example, the protrusion 37 will be interlocked within the opening 27, the protrusion 25 within the opening 15, the protrusion 55 within the opening 85, etc.

Figure 4:
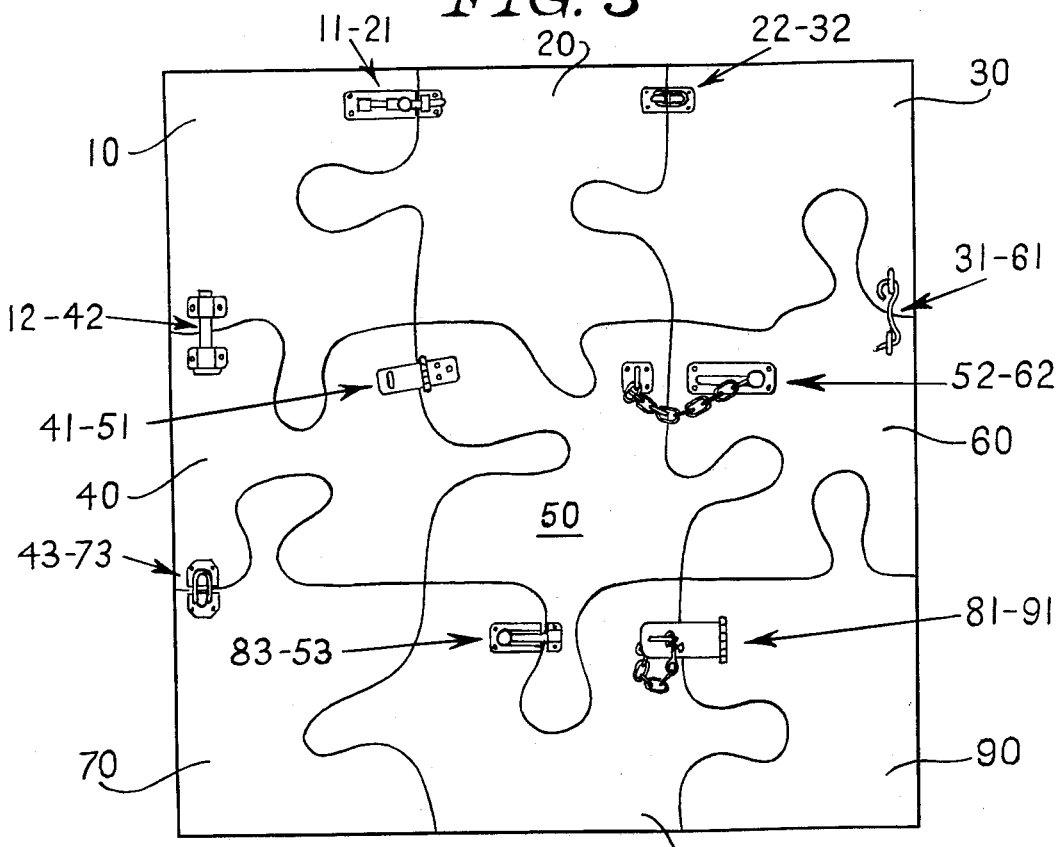
FIG. 4 illustrates the final completed unit wherein the base elements are interconnected and each of the matching pair of elements is appropriately connected together.

In FIG. 3, the hardware elements have been shown disconnected from one another, even though the puzzle parts are connected. Attention should now be directed to FIG. 4 wherein the student has now joined the various hardware elements. For example, the element 52–62 is now in its proper association wherein it becomes a safety chain for utilization on a door, window, or the like. Likewise, the element 31–61 is a hook and eye arrangement and the relationship between these will become apparent to the student utilizing it. Likewise, the element 41–51 is a hasp, or the like, and that will be clear to those using and closing the items after their assembly.

It is to be understood that I have illustrated certain common hardware items of a matching nature to be utilized in this type teaching aid. It is not necessarily limited to such items. For example, it would be perfectly appropriate in such an item to have two matching parts of a door lock, matching parts of an electrical connector, or the like. This device is suitable for making any number of matching-type elements come to the attention of the student in the proper association for teaching purposes. The mere fact that I have illustrated certain elements only does not mean that is all I am interested in. Further, it is to be understood that other configurations of the jigsaw puzzle arrangement could be used, and it is not my desire to imply by the illustrations that this is the only configuration available, although this is one excellent configuration for practicing this invention.

While the embodiment of this invention specifically shown and described is fully capable of achieving the objects and advantages desired, it is to be understood that such embodiment has been shown for purposes of illustration only, and not for purposes of limitation.

I claim:

1. A teaching aid comprising: a jigsaw puzzle comprising a plurality of interlocking parts; at least one part of a multiple part element attached to each jigsaw puzzle piece; a second part of each such element attached to a different jigsaw puzzle piece in such manner that the two parts of the same element match, and interconnect with one another when the jigsaw puzzle pieces are in proper relationship to one another and not in any other position.

2. A teaching aid comprising in combination: a jigsaw puzzle comprised of a plurality of interlocking individual pieces; one portion of a hardware-type item consisting of at least two interconnecting parts attached to each of said jigsaw puzzle pieces adjacent an edge thereof; and a second part of said hardware-type item attached to a different jigsaw puzzle piece adjacent the edge thereof in such manner that it interlocks with the first part when, and only when, the matching jigsaw puzzle pieces are in proper relationship to one another.

3. A teaching aid comprising a jigsaw puzzle including at least nine different pieces, said jigsaw puzzle being in the form of a rectangle when fully assembled; at least one part of a multiple part hardware-type fastener fastened to each piece of the jigsaw puzzle; and the second part of each such hardware-type fastener fastened to an adjacent and matching jigsaw puzzle piece in such manner that the two parts may be connected together when, and only when, the jigsaw puzzle pieces are properly assembled together.

4. The apparatus of claim 3 wherein at least three of the said jigsaw puzzle pieces are equipped with two different parts of two different hardware-type connecting items and wherein each of said three parts of the jigsaw puzzle will match with other parts of the jigsaw puzzle, when properly assembled, in such manner that the connecting portions on each of said three parts of the jigsaw puzzle will connect to a second part of a multiple part element affixed to the other jigsaw puzzle parts.

* * * * *